United States Patent [19]

Strohbeen et al.

[11] 4,377,543

[45] Mar. 22, 1983

[54] STRENGTH AND SOFTNESS CONTROL OF DRY FORMED SHEETS

[75] Inventors: Irene B. Strohbeen, Appleton; James H. Dinius, Neenah, both of Wis.

[73] Assignee: Kimberly-Clark Corporation, Neenah, Wis.

[21] Appl. No.: 310,949

[22] Filed: Oct. 13, 1981

[51] Int. Cl.[3] ..... D04H 1/64

[52] U.S. Cl. ..... 264/120; 264/121; 264/128

[58] Field of Search ..... 264/120, 121, 128

[56] References Cited

U.S. PATENT DOCUMENTS

| | | | |
|---|---|---|---|
| 3,138,533 | 6/1964 | Heim et al. | 167/84 |
| 3,554,862 | 1/1971 | Hervey et al. | 162/158 |
| 3,554,863 | 1/1971 | Hervey et al. | 162/158 |
| 3,556,931 | 1/1971 | Champaigne | 162/158 |
| 3,949,035 | 4/1976 | Dunning et al. | 264/121 |
| 3,976,734 | 8/1976 | Dunning et al. | 264/121 |
| 4,028,457 | 6/1977 | Davey | 264/120 |
| 4,057,669 | 11/1977 | McConnell | 264/128 |
| 4,144,122 | 3/1979 | Emanuelsson | 162/158 |

*Primary Examiner*—James R. Hall

*Attorney, Agent, or Firm*—Leydig, Voit, Osann, Mayer and Holt, Ltd.

[57] ABSTRACT

A method of forming an air-laid web or sheet of wood pulp fibers suitable for tissue and toweling applications comprising airlaying a web of wood pulp fibers, applying water containing a chemical softening agent to the web, pressure bonding the water-treated web to provide dry stength, preferably drying the pressure-bonded web, applying an adhesive containing solution to the dried web to provide increased wet strength, and drying the web to form the finished product. By adding a chemical softening agent to the water applied to the air-laid web ahead of the pressure bonding rolls, the strength and softness of the finished web can be controlled. Alternatively, the chemical softening agent can be added to the printing adhesive solution.

10 Claims, 1 Drawing Figure

STRENGTH AND SOFTNESS CONTROL OF DRY FORMED SHEETS

BACKGROUND OF THE INVENTION

This invention relates to a method for controlling the strength and the softness of fibrous sheet or web products such as tissue and toweling.

Conventionally, disposable tissue (facial as well as bathroom) and towel products have been formed on paper-making equipment by water laying a wood pulp fiber sheet and, thereafter, removing the water either by drying or a combination of pressing and drying. Sheets prepared by water laid methods inherently possess unfavorable tactile properties (e.g., harshness, stiffness, low bulk and poor overall softness) and absorbency. Various downstream techniques are carried out, e.g., creping, to attempt to improve these properties.

While these downstream techniques are successful to varying degrees, drawbacks remain and have led in recent years to increased interest in airforming wood pulp fiber webs. Dry formed sheets or webs prepared by airlaying wood pulp fibers have a combination of attributes which make them highly desirable as substitutes for conventional water laid paper products in a variety of disposable applications.

While the properties of such webs render them very suitable for applications such as tissues and toweling, wide spread use is contingent upon the ability to make the products in an economic fashion. One desirable method utilizes the steps of airlaying wood pulp fibers onto a foraminous carrier to form a substantially dry uncompacted randomly deposited fiber web. This web is then treated with water and pressure bonded between pressure bonding rolls. This treatment provides dry strength but substantially no wet strength. The pressure bonded water treated web is then dried and an adhesive is applied to provide the necessary wet strength.

This method is satisfactory as long as the pressure bonding rolls, which operate at relatively high pressure and necessarily then with concomitant wearing of the roll surfaces, are functioning at the desired bonding level, e.g., circa 20%. When the rolls wear, the bonding level or bonding area (the percentage of the surface of the web which is contacted by the land portions of the rolls) may rise, for example from 20 to 25%. The result is increased dry strength of the base web and reduced softness. When the web is subsequently treated to impart the requisite wet strength (by the addition of an adhesive to the web), the dry strength, which is also increased by the addition of the adhesive, may be too high. And, since dry strength and softness are inversely related, the increase in dry strength beyond the desired maximum level results in an undesirable reduction in the softness of the product.

This invention then is directed to a method for controlling the dry strength and softness of the finished product in such a manner that the desired wet strength can be attained without an undesirable increase in dry strength (when the base sheet dry strength is already high) and the concomitant undesirable reduction in softness.

SUMMARY OF THE INVENTION

The subject invention is directed to a method for preparing air-laid webs of wood pulp fibers suitable for tissue and toweling applications having the requisite dry and wet strength as well as the requisite softness.

The process of the subject invention comprises the steps of (a) forming an air-laid web of wood pulp fibers by airlaying wood pulp fibers onto a moving foraminous carrier to form a substantially dry and uncompacted web of randomly deposited fibers, (b) applying a chemical softening agent to the web in the water used to wet the web prior to the pressure bonding, (c) pressure bonding the water-treated web to provide dry strength, (d) drying the pressure bonded web, (e) applying adhesive to the dried web to provide increased wet strength and concurrently additional dry strength and (f) drying the web to form a finished product. The downstream steps of calendering and forming the web into reel form may also be carried out but do not per se form a part of this invention. As an alternative to adding the chemical softening agent to the water applied to the web prior to pressure bonding, the chemical softening agent can be added to the adhesive which is added to the web to provide wet and concurrently additional dry strength. As a second and less preferred alternative, step (d) above can be eliminated.

The softening agents useful in this invention are water soluble or dispersible, have the ability to reduce the strength of pressure bonded dry-formed (airlaid) sheets and are compatible with the adhesive added to provide wet strength. The preferred softening agent is dimethyl di-tallow quaternary ammonium chloride.

BRIEF DESCRIPTION OF THE FIGURE

The drawing is a simplified diagrammatic illustration of an apparatus which can be used in practicing the subject invention.

DESCRIPTION OF THE PREFERRED EMBODIMENT

Figure 1:
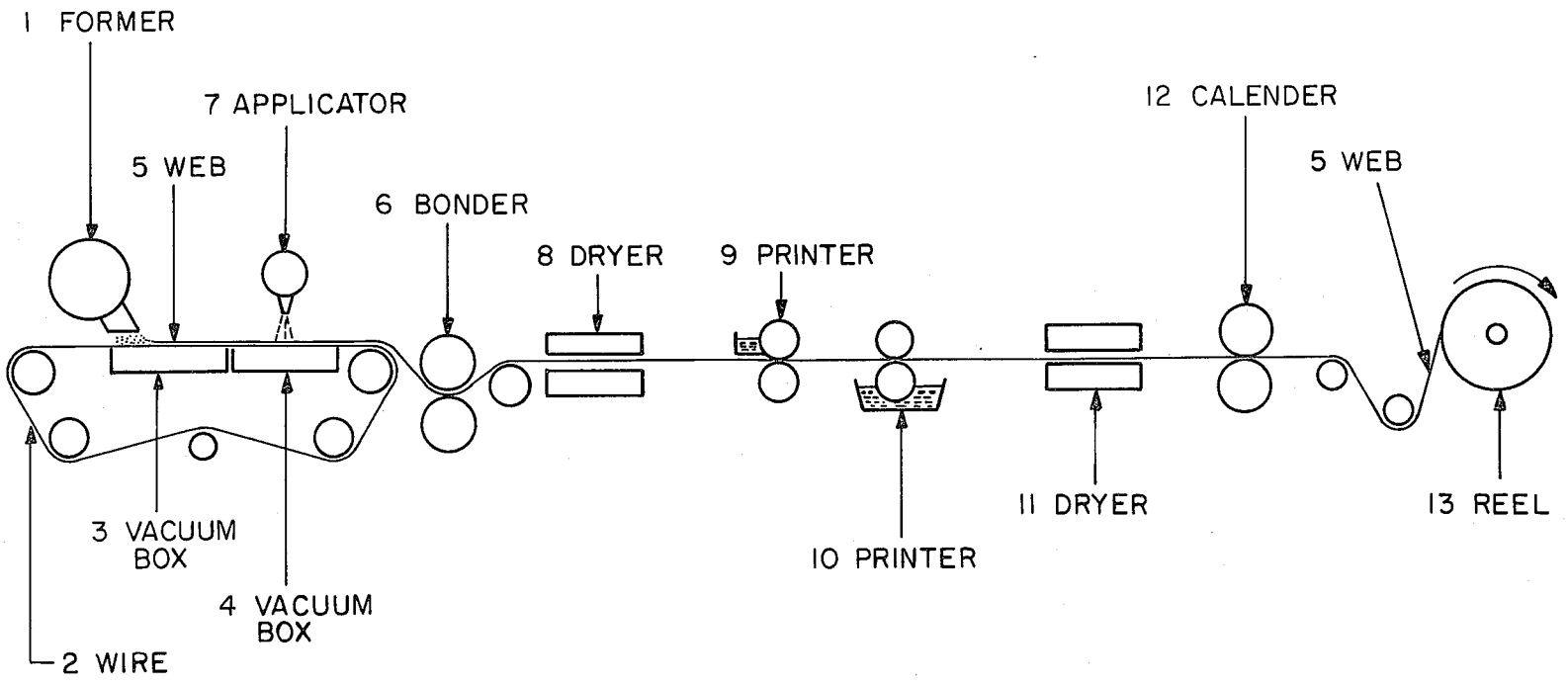

While the invention will be described in connection with the preferred embodiments, it should be understood that it is not intended to limit the invention to those embodiments. On the contrary, it is intended to cover all alternatives, modifications and equivalents as may be included within the spirit and scope of the invention.

The subject invention can be practiced using an apparatus such as that shown in the drawing. Specifically, wood pulp fibers (which may be produced for instance by a divellicating means such as a picker roll) are conveyed through a former 1 onto a moving foraminous wire carrier 2. Air from the former 1 in conjunction with vacuum boxes 3 and 4 creates a downwardly moving stream of air which assists in collecting the air formed web on the foraminous wire. (Customary air forming techniques can be utilized in forming the web.) An illustrative former (or duct) is disclosed in U.S. Pat. No. 3,976,734.

The web 5 is carried from the forming section via the foraminous wire 2 toward the bonding rolls 6. Prior to passing between the pressure rolls of the bonding rolls 6, the substantially dry air-laid web 5 is sprayed with water, and a chemical softening agent as required, by applicator 7.

After passing through the bonding rolls 6, the web 5 moves through a drier 8 following which adhesive is applied to the web by printers 9 and 10. The web is then dried in a drier 11 following which it passes through calendering rolls 12 and is then formed into a finished reel product 13.

Careful control of the dry strength and softness of the web as it proceeds through the various steps involved in preparing the finished product must be maintained. For example, if a facial tissue having a dry tensile strength in the machine direction of 75.5 g/cm. a wet tensile strength in the cross direction of 15.8 g/cm. and a softness of 7.5 on a scale of 1 (least soft) to 8 (softest) is desired, only a limited amount of dry strength may be incorporated into the fibrous web by the bonding rolls 6.

If too high a dry strength is imparted to the web by the bonding rolls 6, then the subsequent required step of applying adhesive to the web to provide the requisite wet strength will give a dry strength which is too high since the adhesive also provides some additional dry strength. Correspondingly, the resulting product will have an undesirable lower softness.

The problem described above can arise when the bonding rolls 6 become excessively worn. Because of the high pressure at which the bonding rolls operate, this can occur relatively frequently and, prior to the subject invention, required the shut down of the process and the refurbishing of the bonding rolls, an expensive undertaking from both the standpoint of down time and the cost associated with refurbishing the rolls.

By the subject invention the frequency of replacement and refurbishing of the bonding rolls is substantially reduced. That is, if a chemical softening agent is introduced into (1) the water applied to the air-laid web at applicator 7 or, alternatively, (2) into the adhesive solution added to the web at printers 9 and 10, the dry strength of the air-laid web can be controlled as required to offset the wear of bonding rolls 6 which, as wear progresses, operate with increased bonding areas resulting in increased dry strength of the web. By correlating the dry strength of the web coming out of the bonding section 6, e.g., by measurement of the bonding area or by physically measuring the machine direction dry tensile strength of the product, the amount of chemical softening agent to be added can be determined. In this manner, the final dry strength of the finished product—which is a combination of the dry strength provided by the pressure rolls of the bonder 6 and that derived from the adhesive added to the web to provide wet strength—can be maintained at the desired level.

The chemical softening agents useful in the subject invention are characterized by having the following properties:

1. complete water solubility or dispersability;
2. the ability to reduce the strength of a pressure bonded dry-formed (airlaid) sheet by partially preventing inter-fiber paper-making bonds (H-bonds) from forming during the drying procedures used in forming air-laid webs;
3. compatability with the adhesive and the ability to plasticize or soften the adhesive bond; and
4. effectiveness in providing softening over a range of from about 0.003% to about 1% (percentage based on the weight of the fibrous sheet) addition to the fiberous sheet.

Representative chemical softening agents useful in this invention include:

1. di-alkyl di-methyl quaternary ammonium chloride of the type $R_1 R_2 N(CH_3)_2 Cl$ where $R_1$ and $R_2$ are alkyl groups of 12 to 18 carbon atoms, preferably stearyl chains provided by tallow. The tallow may be hydrogenated.
2. dimethyl dicoco ammonium chloride.
3. dimethyl disoya ammonium chloride.
4. polyethoxylated quarternary ammonium salts having alkyl groups of 12 to 18 carbon atoms.

Preferably, as indicated above, the softening agents used in this invention are cationic long chain fatty alkyl compounds having at least 12 carbon atoms in at least one alkyl chain. A particularly preferred softening agent usefulin the subject invention is dimethyl di-tallow quarternary ammonium chloride. This chemical is commercially available under the tradename ARMOSOFT L from Armak Company.

The chemical softening agent will typically be applied in an amount of from about 0.003% to about 1.0% weight (based on the dry weight of the web). It will typically be applied as a 0.01 to about 3.0 weight % solution in water when applied to the dry web prior to its entry into the bonding rolls.

As previously mentioned, the chemical softening agent can also be added to the web in the printer section (9 and 10) in which event it will be dissolved or dispersed in the adhesive solution applied to the web at this point. Typically the concentration of the chemical softening agent in the adhesive solution will be from about 0.01 to about 3.0 weight % (based on the weight of the adhesive solution prior to addition of the softening agent) with from about 0.005 weight % to about 1.5 weight % of the softening agent being added to the web (based on the dry weight of the web).

To further illustrate the subject invention, the following examples are provided. In all of the examples an apparatus as generally set out in the drawing was used. In all of the examples Northern softwood kraft fibers were used to form an air-laid web having a basis weight of 29 g/m$^2$. In all the examples Parez 631, a modified polyacrylamide in water was used as the adhesive. Other wet strength enhancing adhesives may also be used. The nature of these adhesives is not critical to this invention, other than that they are compatible with the softening agent used and, of course, provide the requisite wet strength. Representative adhesives useful in this invention are disclosed in U.S. Pat. Nos. 3,058,873 and 2,926,116.

Examples 1 and 4 are controls for comparison purposes in which no chemical softener was used. In examples 2 and 3 the chemical softener was added via a sprayer (7 in the drawing) with 43 weight % (based on the dry fiber) moisture addition. In Examples 5 through 7 the chemical softener was added via the printers (9 and 10 in the drawing) with a total of 50 weight % (based on the dry fiber) moisture added. Examples 1–3 were run at 1000 fpm (305 m/min). Examples 4–7 were run at 300 fpm (91 m/min.)

Machine direction (dry) and cross-direction (wet) strengths of the finished product were measured using 3 inch by 7 inch samples and an Instron tester (Model No. 1101) with a 4 inch jaw span at a cross-head speed of 2 inches per minute, 1000 g. full-scale load. Wet strengths were measured by wetting the center of the samples immediately prior to testing. The results obtained are set out in the following table.

TABLE

EFFECT OF CHEMICAL SOFTENING AGENT ON FINISHED PRODUCT STRENGTHS

| Examples | Added Via: | % Armsoft L % in Sol'n[1] | % Armsoft L % Dry Solids[2] | % Parez % in Sol'n[1] | % Parez % Dry Solids[2] | Machine Direction Dry Strength (g/cm) | Cross Direction Wet Strength (g/cm) | Wet Strength: Dry Strength Ratio |
|---|---|---|---|---|---|---|---|---|
| 1 | Sprayer | 0 | 0 | 0.65 | 0.33 | 72.2 | 14.0 | 19.5% |
| 2 | Sprayer | .035 | .015 | 1.4 | 0.7 | 72.3 | 15.6 | 21.6% |
| 3 | Sprayer | .105 | .045 | 2.0 | 1.0 | 72.2 | 18.2 | 25.3% |
| 4 | Printer | 0 | 0 | 0.1 | 0.05 | 74.3 | 11.2 | 15.0% |
| 5 | Printer | .3 | .15 | 0.4 | 0.20 | 68.8 | 15.8 | 22.9% |
| 6 | Printer | .5 | .25 | 0.6 | 0.30 | 72.1 | 18.4 | 25.5% |
| 7 | Printer | .8 | .40 | 0.6 | 0.30 | 68.1 | 17.7 | 26.0% |

% In Solution refers to the weight concentration of Armsoft L (or Parez) in the solution being applied to the web.
% Dry Solids refers to the weight concentration of Armosoft L (or Parez) in the web as a percentage of the weight of the dry web.

As can be seen from the foregoing description, the present invention provides a method for controlling the softness and strength characteristics of dry laid (air-laid) fiber sheet products. It should be understood that various changes in processing variables and combination of processing variables can be made without departing from the spirit of this invention. For instance, the chemical softening agent can be applied to the web via both the water applied to the web upstream of the pressure rolls (bonder) and the water based adhesive solution downstream of the pressure rolls. Additionally, the application of the adhesive to the web downstream of the bonder need not be by printing rolls but can be carried out by a spray application or the like.

What is claimed is:

1. In a process for forming an air laid web of wood pulp fibers comprising the steps of:

(a) airlaying wood pulp fibers onto a moving foraminous carrier to form a substantially dry and uncompacted web of randomly deposited fibers, (b) applying water to the web of step (a), (c) pressure bonding the water treated web of step (b) to provide dry strength, (d) drying the pressure bonded web of step (c), (e) applying adhesive to the dried web of step (d) to provide increased wet strength and coincidentally dry strength, and (f) drying the web of step (e) to form a web with both wet and dry strength, the improvement comprising:

controlling the softness and strength of the web of step (f) by adding a chemical softening agent to the water applied to the web in step (b) above.

2. The process of claim 1, wherein said chemical softening agent is dimethyl di-tallow quaternary ammonium chloride.

3. The process of claim 1, wherein said chemical softening agent is applied as an aqueous solution having a concentration of from about 0.01 to about 3.0 weight %.

4. The process of claim 1, wherein said chemical softening agent is applied in an amount of from about 0.003 to about 1.0 weight percent based on the dry weight of the web.

5. In a process for forming an air laid web of wood pulp fibers comprising the steps of:

(a) airlaying wood pulp fibers onto a moving foraminous carrier to form a substantially dry and uncompacted web of randomly deposited fibers, (b) applying water to the web of step (a), (c) pressure bonding the water treated web of step (b) to provide dry strength, (d) drying the pressure bonded web of step (c), (e) applying an aqueous solution of an adhesive to the dried web of step (d) to provide increased wet strength and coincidentally dry strength, and (f) drying the web of step (e) to form a web with both wet and dry strength, the improvement comprising:

controlling the softness and strength of the web of step (f) by adding a chemical softening agent to said aqueous solution of an adhesive applied to the web in step (e) above.

6. The process of claim 5, wherein said chemical softening agent is dimethyl di-tallow quaternary ammonium chloride.

7. The process of claim 5, wherein said chemical softening agent is applied as an aqueous solution having a concentration of from about 0.01 to about 3.0 weight %.

8. The process of claim 5, wherein said chemical softening agent is applied in an amount of from about 0.005 to about 1.5 weight % based on the dry weight of the web.

9. In a process for forming an air laid web of wood pulp fibers comprising the steps of:

(a) airlaying wood pulp fibers onto a moving foraminous carrier to form a substantially dry and uncompacted web of randomly deposited fibers, (b) applying water to the web of step (a), (c) pressure bonding the water treated web of step (b) to provide dry strength, (d) applying adhesive to the web of step (c) to provide increased wet strength and coincidentally dry strength, and (e) drying the web of step (d) to form a web with both wet and dry strength, the improvement comprising:

controlling the softness and strength of the web of step (e) by adding a chemical softening agent to the water applied to the web in step (b) above.

10. In a process for forming an air laid web of wood pulp fibers comprising the steps of:

(a) airlaying wood pulp fibers onto a moving foraminous carrier to form a substantially dry and uncompacted web of randomly deposited fibers, (b) applying water to the web of step (a), (c) pressure bonding the water treated web of step (b) to provide dry strength, (d) applying an aqueous solution of an adhesive to the web of step (c) to provide increased wet strength, and (e) drying the web of step (d) to form a web with both wet and dry strength, the improvement comprising:

controlling the softness and strength of the web of step (e) by adding a chemical softening agent to said aqueous solution of an adhesive applied to the web in step (d) above.

* * * * *